United States Patent [19]

Viessmann

[11] 4,351,248

[45] Sep. 28, 1982

[54] HEATING BOILER FOR THE COMBUSTION OF BALED STRAW

[76] Inventor: Hans Viessmann, Im Hain, 3559 Battenberg, Fed. Rep. of Germany

[21] Appl. No.: 298,760

[22] Filed: Sep. 2, 1981

[30] Foreign Application Priority Data

| | | | |
|---|---|---|---|
| Sep. 13, 1980 | [DE] | Fed. Rep. of Germany | 3034668 |
| Jan. 9, 1981 | [DE] | Fed. Rep. of Germany | 8100295[U] |
| Mar. 14, 1981 | [DE] | Fed. Rep. of Germany | 3109910 |
| Mar. 14, 1981 | [DE] | Fed. Rep. of Germany | 3109915 |
| Mar. 14, 1981 | [DE] | Fed. Rep. of Germany | 3109917 |

[51] Int. Cl.[3] ..... F23J 1/06

[52] U.S. Cl. ..... 110/170; 110/234; 110/175 R; 122/2

[58] Field of Search ..... 110/234, 235, 242, 248, 110/251, 255, 259, 168, 170, 165 R, 175 R; 122/2

[56] References Cited

U.S. PATENT DOCUMENTS

| | | | |
|---|---|---|---|
| 297,170 | 4/1884 | Rumely | 110/234 |
| 2,540,670 | 2/1951 | Hoenecke | 110/165 R |
| 3,282,233 | 11/1966 | Richter | 110/175 R |
| 4,084,521 | 4/1978 | Herbold et al. | 110/242 |
| 4,102,279 | 7/1978 | Groschl et al. | 110/234 |
| 4,312,278 | 1/1982 | Smith et al. | 110/234 |

*Primary Examiner*—Henry C. Yuen
*Attorney, Agent, or Firm*—Kurt Kelman

[57] ABSTRACT

A heating boiler for substantially continuous controlled combustion of baled straw. The boiler includes a straw feed channel communicating with a combustion chamber having a combustion zone adjacent the rear wall of the combustion chamber, a flue gas heat exchange chamber above the combustion chamber in communication with a flue gas vent and an ash collecting pit below the combustion chamber. A horizontal floor is disposed between the combustion chamber and the ash collecting pit, the floor having a slot adjacent the rear wall of the combustion chamber for passage of ash from the combustion zone into the ash collecting pit and for intake of primary air into the combustion zone. A vertically rotatable ash stripper assembly extends from the rear wall of the combustion chamber, and serves to strip ash from the straw bale surface being combusted in the combustion zone. The ash stripper assembly can be rotated by means of a hollow shaft which also constitutes a secondary air intake. The boiler provides for substantially continuous combustion of the baled straw in a controlled fashion by restricting combustion to the area of the combustion zone adjacent the rear wall of the combustion chamber.

16 Claims, 15 Drawing Figures

17
16
4'
8
5'
9
2
14
4
13
1
3
7
6

5'
5'
9
10
12
18
11
11

10
9
7
15
5'
2
2'

4
4"
15
15
9
11
4
13
15
15

Fig.6
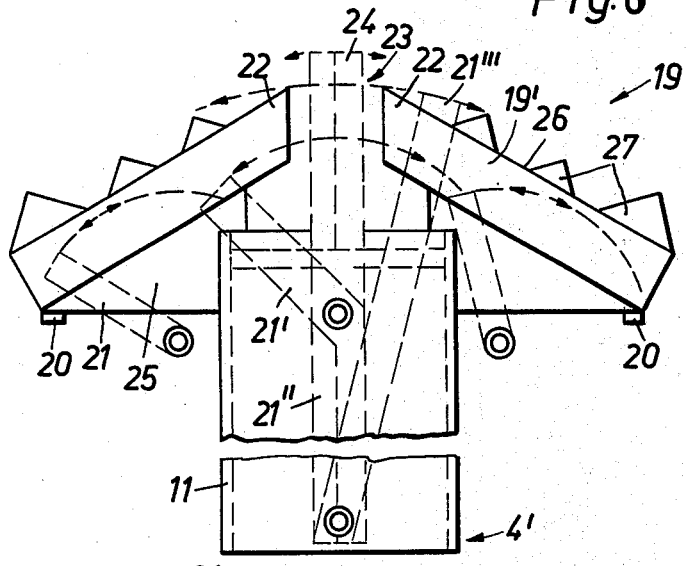
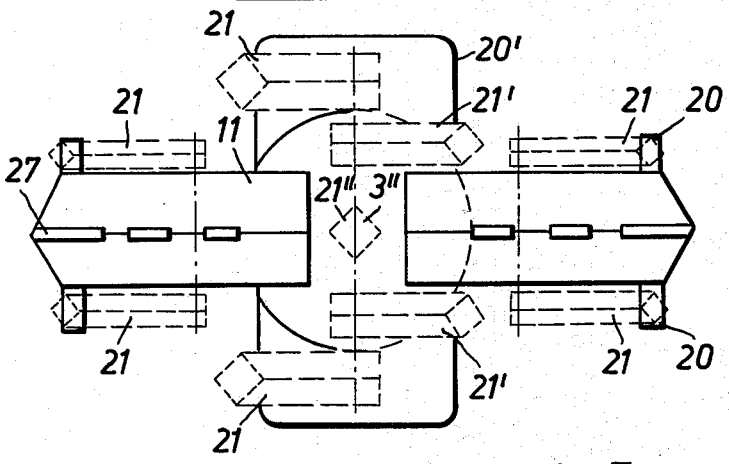
Fig.7

Fig. 13
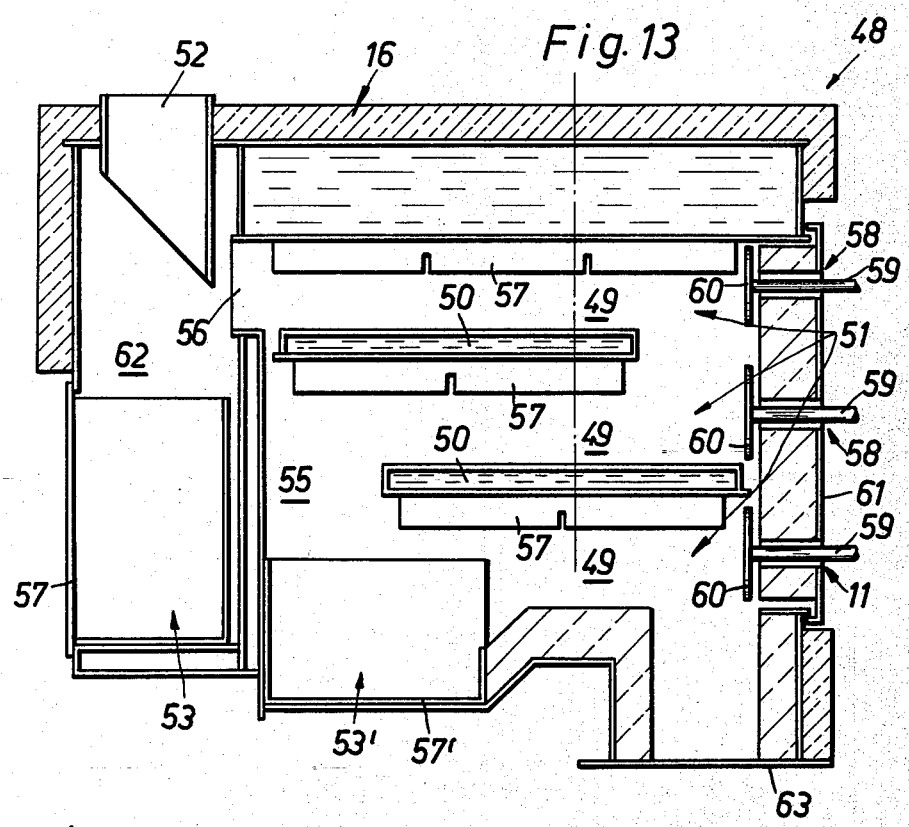
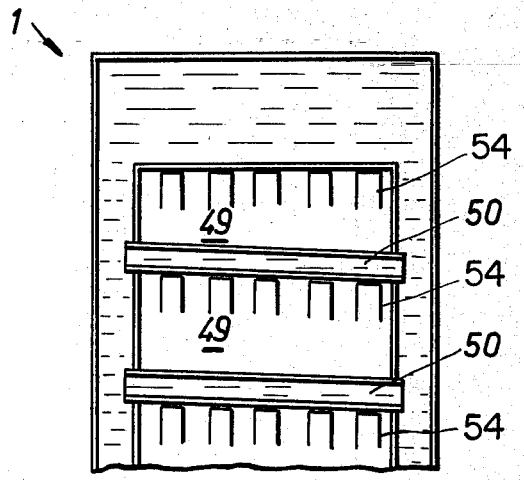
Fig. 14
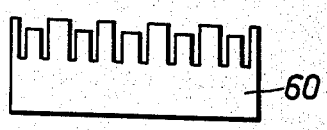
Fig. 15

HEATING BOILER FOR THE COMBUSTION OF BALED STRAW

BACKGROUND OF THE INVENTION

1. Field of the Invention

The present invention relates to a heating boiler for substantially continuous controlled combustion of baled straw.

2. Prior Art

Heating boilers of the type taught in West German Offenlegungsschrift No. 24 00 778 are refuse incinerators in which a plug of refuse is shoved through a shaft, by means for example of a conveyor screw, into a fire box. This type of heating boiler is unsuitable for continuous controlled combustion of baled straw due to the different combustion characteristics of baled straw relative to typical refuse, and even relative to straw that has not been so compressed.

The use of a heating boiler of the type taught in West German Offenlegungsschrift No. 24 00 778 for the combustion of straw results in an uncontrolled fire within the feed channel or a fire which either self-extinguishes or smolders and provides very incomplete combustion of the straw due to the formation of an ash crust which interferes with access to the straw of the necessary combustion air.

SUMMARY OF THE INVENTION

The present invention provides a heating boiler for substantially continuous combustion of baled straw.

The heating boiler includes a straw feed channel communicating with a combustion chamber having a combustion zone adjacent the rear wall of the combustion chamber, a flue gas heat exchange chamber above the combustion chamber in communication with a flue gas vent and an ash collecting pit below the combustion chamber. A horizontal floor is disposed between the combustion chamber and the ash collecting pit, the floor having a slot adjacent the rear wall of the combustion chamber for passage of ash from the combustion zone into the ash collecting pit and for intake of primary air into the combustion zone. A vertically rotatable ash stripper assembly extends from the rear wall of the combustion chamber, and serves to strip ash from the straw bale surface being combusted in the combustion zone. The ash stripper assembly can be rotated by means of a hollow shaft which also constitutes a secondary air intake. The boiler provides for substantially continuous combustion of the baled straw in a controlled fashion by restricting combustion to the area of the combustion zone adjacent the rear wall of the combustion chamber.

In one particular aspect the present invention provides a heating boiler for the combustion of baled straw, comprising an enclosed straw feed channel, provided with conveyor means, communicating with a combustion chamber having a combustion zone adjacent the rear wall of the combustion chamber, a flue gas heat exchange chamber above the combustion chamber and in communication with a flue gas vent, an ash collecting pit below the combustion chamber, a horizontal floor disposed between the combustion chamber and the ash collecting pit and having a slot adjacent the rear wall of the combustion chamber for passage of ash from the combustion zone into the ash collecting pit and for intake of primary air into the combustion zone, an ash stripper assembly extending from the rear wall of the combustion chamber and movable in a vertical plane to strip ash from the surface of a straw bale being combusted in the combustion zone, and at least one secondary air intake in the rear wall of the combustion chamber.

It has been found that the feeding of primary air by way of the slot above which the combustion zone is located, that is the zone in which the leading face of the straw bale is combusted, together with the feeding of secondary air to the center of the combustion zone and the concurrent stripping of ash, by the ash stripper assembly, without disturbing the straw being combusted per se, permits continuous uniform combustion of the leading surface of the straw bale.

An important feature of the heating boiler is the fact that the entire floor of the combustion chamber is not simply designed in the form of a grate, as is customary, but rather is a solid floor with the slot which restricts the access of primary air to substantially only the combustion zone.

It is also advantageous to construct the ash stripper assembly in such a manner as to additionally constitute a secondary air intake. This can be accomplished by employing an ash stripper assembly having one or more arms bearing ash stripper elements mounted upon a hollow shaft, of suitable proportions, which extends through the rear wall of the combustion chamber and through which secondary air can be drawn or, if necessary, injected by means for example of a blower fan. The use of the hollow shaft as the secondary air intake provides for cooling of the ash stripper assembly and concurrent preheating of the secondary air. The hollow shaft can be rotated, in alternate directions and at preset intervals if desired, by suitable drive means remote from the combustion chamber.

The ash stripper assembly can also be constructed so that the hollow shaft is axially movable against the pressure of spring means remote from the combustion chamber and can be associated with a regulating element, which senses or is indicative of the shaft position, and which in turn is associated with means, such as an impulse transmittor, connected to the drive means for either or both the ash stripper assembly and the conveyor means.

It has also been found that the efficiency of the combustion zone is enhanced by providing wedge-like elements in the corners of the combustion chamber which further compress the baled straw entering the combustion zone. The wedge-like elements, which can if desired be readily formed integrally as a part of the masonry lining, are particularly useful when horizontally fed round straw bales are used as fuel since the leading edge being fed to the combustion zone is compressed to a generally circular shape substantially of the size and shape of the area acted upon by the ash stripper elements of the ash stripper assembly. Otherwise, corner areas of the leading face of a bale would be combusted at a substantially slower rate than that portion of the leading face from which ash is stripped by the ash stripper assembly.

It is of course possible, dependent upon the cross-sectional size of the overall combustion chamber and the cross-sectional size of the combustion zone, considerations affected by the straw bale size or the number of straw bales intended to be fed concurrently, to provide a plurality of ash stripper assemblies distributed symmetrically about the central point of the combustion zone.

BRIEF DESCRIPTION OF THE DRAWINGS

FIG. 6 is a top plan of a portion of a particularly preferred embodiment of an ash stripper assembly;

FIG. 7 is a front elevation of the ash stripper assembly of FIG. 6;

FIG. 13 is a longitudinal section of a preferred embodiment of a flue gas heat exchange chamber;

FIG. 14 is a cross-section of the upper portion of the flue gas heat exchange chamber of FIG. 13; and FIG. 15 is a side elevation of a slide plate of a cleaning element for cleaning a passage of the flue gas heat exchange chamber.

DETAILED DESCRIPTION OF THE INVENTION

Figures 1, 2, 3, 4, 5:
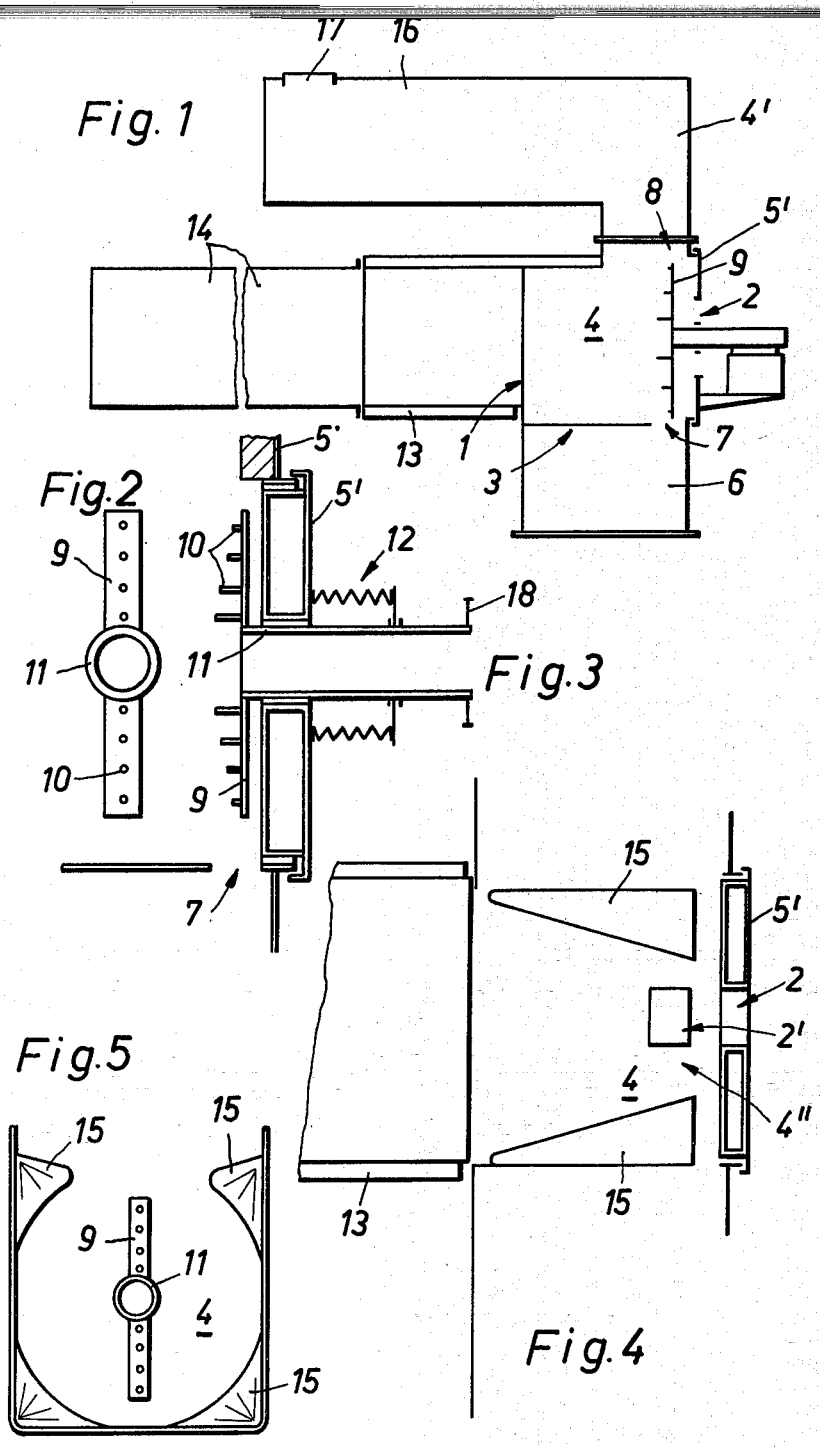
FIG. 1 is a schematic longitudinal section of a heating boiler according to the present invention.
FIG. 2 is a front elevation of one embodiment of an ash stripper assembly.
FIG. 3 is a schematic cross-section of an ash stripper assembly similar to that of FIG. 2 mounted in association with the rear wall of a combustion chamber.
FIG. 4 is a schematic top plan of an embodiment of a combustion chamber according to the present invention.
FIG. 5 is a schematic front elevation of a combustion chamber as viewed from the straw feed channel.

Referring now to FIG. 1, straw bales are fed continuously from a straw feed channel 14 through a feed opening 1 into a combustion chamber 4 having a combustion zone 8 adjacent the rear wall 5. The walls 13 of the straw feed channel 14 can be provided, if desired, with external installation and/or a fireproof lining, particularly in the zone adjacent the combustion chamber 4. The solid, horizontal floor 3 of the combustion chamber 4 is provided with a slot 7 which extends across the width of the combustion chamber 4 adjacent the rear wall 5 to permit flow of primary air from an ash collecting pit 6 to the combustion zone 8. A flue gas heat exchange chamber 16 is disposed above the combustion chamber 4 and is provided with a flue gas vent 17. An ash stripper assembly is mounted for rotation in a journal aperature 2 provided in a combustion chamber door 5' in the combustion chamber rear wall 5.

The ash stripper assembly, better seen in FIGS. 2 and 3, includes a hollow shaft 11 having a cross arm member 9 provided with stripper elements 10 which can be in the form of vanes or fingers. The ash stripper assembly, as seen particularly in FIG. 3, is mounted in the liquid-jacketed combustion chamber door 5' which is approximately of the dimensions of the feed opening 1 of the combustion chamber 4. The hollow shaft 11, which constitutes a secondary air intake, is axially movable against the pressure of spring means 12, and can be rotated by drive means 18.

In operation of the heating boiler, combustion of the baled straw is restricted substantially to the area of the combustion zone 8 above the primary air intake slot 7. The rotating ash stripper assembly gently brushes off the ash forming on the leading surface of the straw bale being combusted without disturbing the combustion process per se, while concurrently feeding secondary air to the combustion zone to enhance combustion rate and uniformity.

Combustion uniformity over the straw bale leading surface is also enhanced by providing wedge-like members 15, as illustrated in FIGS. 4 and 5, in the combustion chamber 4 to further compress the baled straw entering the combustion zone into a generally circular shape substantially of the size and shape of the area acted upon by the ash stripper elements of the ash stripper assembly.

The intake of secondary air by means of the hollow shaft 11 generally renders unnecessary the provision of further secondary air intake openings, although further secondary intake openings can be provided, as can be seen for example in FIG. 4, in the flanking walls 4" of the combustion chamber 4 if required.

A particularly preferred embodiment of an ash stripper assembly is illustrated in FIGS. 6 and 7. To the hollow shaft 11 are attached, by means of triangular support plates 25, complementary arms 19', which together form the bar 19, bearing the triangular ash stripper elements 27 on the leading face 26.

Through an opening 23 between the ends 22 of arms 19' extends a central stripper 21" mounted in the shaft 11 so that the end 24 of the stripper 21" projects somewhat in advance of the arms 19'.

Flanking strippers 21 are rotatably mounted for movement along the arms 19' between the hollow shaft 11 and stops 20 so that during rotation of the ash stripper assembly the flanking strippers 21 prevent the build-up of ash, residue or crust on arms 19'.

On the same axis as that of the central stripper 21", which moves back and forth during rotation of the hollow shaft 11, are attached strippers 21''' which also move back and forth to prevent material build-up in the area of the end portions 22 of the arms 19'.

Further strippers 21' can also be mounted externally on the hollow shaft 11 for movement between bale-shaped stops 20'.

During rotation of the ash stripper assembly, all of the strippers move back and forth between their stops while concurrently the arms 19' bearing the ash stripper elements 27 act as ash dislodging beaters.

The arms 19' can be designed as narrow rectangular tubes, and can be in fluid communication with the interior of the hollow shaft 11, if desired, to take advantage of the cooling effect imparted by the intake of secondary air through the hollow shaft 11.

It is also contemplated, dependent upon the particular configuration of the ash stripper assembly, that the buildup of ash, residue or crust could be prevented by provision solely of suitably dimensioned flanking strippers 21.

Figure 8:
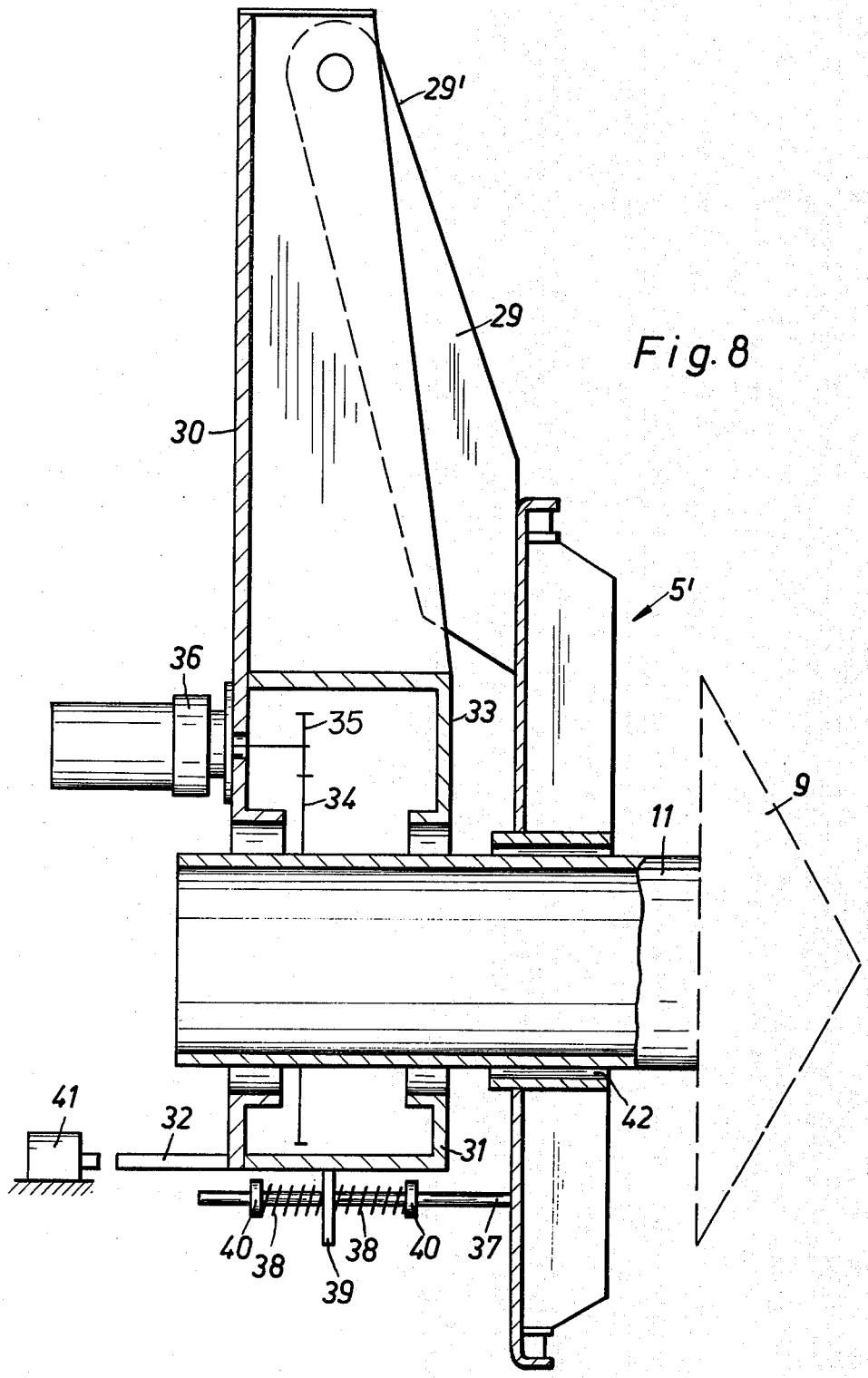
FIG. 8 is a side elevation partly in section, of a preferred embodiment of a combustion chamber rear wall door and associated ash stripper assembly mounting and drive means.
Figure 9:
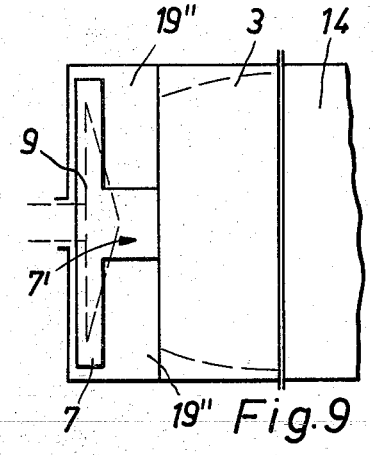
FIG. 9 is a schematic top plan of an alternate embodiment of a combustion chamber floor.

The ash stripper assembly is preferably mounted, as illustrated in FIG. 8, in such a manner as to provide means for regulating the speed of the conveyor means by which the baled straw is fed to the combustion chamber. In the embodiment illustrated, the hollow shaft 11, upon which is mounted the stripper arms/stripper elements which are simply identified in stippled lines as component 9, is mounted in the combustion chamber door 5' by means of a bracket 29 from the upper end 29' of which is pivotally suspended a bearing mounting assembly 30 which includes a housing 33 for the hollow shaft 11. Shaft bearings (not shown) are seated in the housing 33, as is a pinion gear 34 which encircles hollow shaft 11 and meshes with a driving pinion gear 35 powered by a motor 36 attached to the exterior of the housing 33. The bottom 31 of the housing 33 is provided with a downwardly extending plate 39 through which projects a rod 37 attached to the combustion chamber door 5'. Springs 38 are maintained on the rod 37 on either side of the plate 39 by means of adjusting nuts 40. In addition, the bottom 31 of the housing 33 includes a control extension member 32, opposite from which is suitably mounted an impulse transmittor 41 connected to the drive for the conveyor means by which the baled straw is fed to the combustion chamber.

Thus, activation of the impulse transmittor 41 due to contact by the control extension member 32, due in turn to axial movement of the hollow shaft 11 because of pressure imparted to the ash stripper assembly by the face of a straw bale, can result in slowing and/or temporary stoppage of drive for the conveyor means while combustion proceeds to a degree sufficient to permit return of the hollow shaft 11 to a normal operation position.

The lengths of the bracket 29 and the bearing mounting assembly 30 can be selected so that axial movement of the hollow shaft 11 translates as a relative radial movement sufficiently small as to permit retention of an effective seal between the journal opening 2 and the hollow shaft 11.

The weight of all of the component parts 9, 11, 30, 31, 32, 33, 34, 35, 36 and 39 is carried by the bracket 29, the result of which is an extremely sensitive pendulum action, controllable by means of the adjusting nuts 40.

Figure 10:
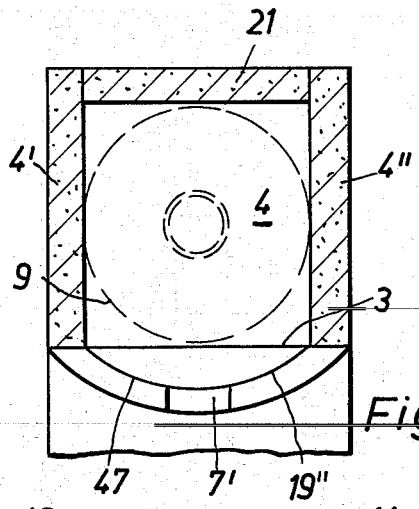
FIG. 10 is a schematic front elevation, partly in section, of the combustion chamber of FIG. 9.
Figure 11:
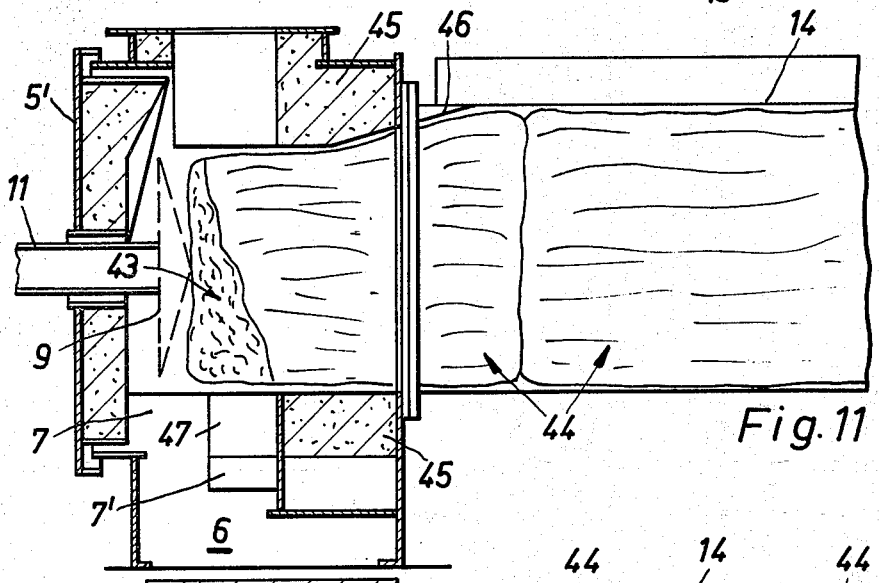
FIG. 11 is a schematic longitudinal section of an embodiment particularly adapted for combustion of round straw bales.

In the embodiment illustrated in FIGS. 9 to 12, an alternate form of floor 3 is employed in the combustion chamber 4. Specifically, a section of the floor adjacent the primary air slot 7 is provided with a centrally disposed longitudinal slot 7' intermediate complementary downwardly curved portions 19''. As in the case of FIG. 8, in each of FIGS. 9, 11 and 12 the ash stripper arms/stripper elements are simply identified in stippled lines as component 9, having previously been described in detail. In the case of FIG. 10, the circle 9 appearing in stippled lines simply identifies the working area of the ash stripper assembly.

The T-shaped slot formed by slots 7 and 7', when viewed in top plan, together with the sloping of curved portions 19'' results in the leading surface of the straw bale being disposed clear of the floor above the slot 7'. Thus, the primary air can make particularly good contact with the bottom of the bale which thereby combusts, with reference to FIG. 11, in the area 43 at the face of the bale. This particular form of floor structure is particularly efficient, in conjunction with the action of the ash stripper assembly, in achieving continuous, relatively uniform combustion.

Figure 12:
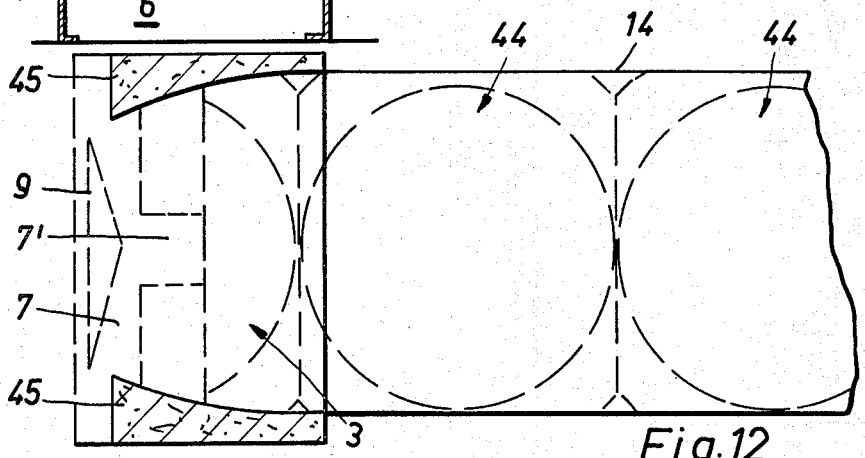
FIG. 12 is a schematic horizontal cross-section of an embodiment particularly adapted for combustion of round straw bales.

Large round bales of straw (e.g. 1.5 m long and 0.8 m thick/300,000 k cal/h) can be combusted most advantageously by feeding such bales in lying on their sides. For this reason, the straw feed channel 14 can be designed in a horizontally rectangular shape with a cross-section matched to accept round bales 44 lying on their sides as shown in FIG. 12. Because of compacting occuring in the straw feed channel 14 as a result of the conveying means the round bales are pressed into a generally rectangular shape (as shown in outline only) for which reason a unitary or sectional shaper means 45 can be provided to reshape the straw bale into approximately the size and shape of the area acted upon by the ash stripper elements of the ash stripper assembly. In other words, the function of the unitary or sectional shaper means 45 is similar to that of the wedge-like members 15 illustrated in FIGS. 4 and 5. A deflector plate 46, shown in FIG. 11, can be positioned intermediate the straw feed channel 14 and the shaper means 45 to provide a smoothly sloping connection. The walls 4'' and roof 21 of the combustion chamber 4 are typically lined with a fire-proof material, and the unitary or sectional shaper means 45 and any deflector plate 46 can be formed of similar fire-proof material or even formed integrally during installation.

Control of the bale conveyor speed to substantially match the progress of combustion need not necessarily be done by means of the ash stripper assembly. It is also entirely possible to provide means associated with the conveyor means to retard the rate of and/or shut off the drive when the sensed resistance to forward movement of the baled straw in the straw feed channel 14 becomes too great. In such a case, the hollow shaft 11 of the ash stripper assembly need not be axially movable, and any associated sensing and transmitting means could be dispensed with.

While the heating boiler has been discussed primarily with reference to the use of round straw bales as the feed material form, the inventive concept is equally applicable to the feed straw material being in the form of cubes or rectangular prisms.

FIGS. 13 to 15 relate to a form of flue gas heat exchange chamber 16 particularly designed for optimal utilization of the heat of combustion of the straw.

The flue gas heat exchange chamber 16 comprises a liquid-jacketed housing 48 within which are liquid-conducting partitions 50 defining separate horizontal passages 49 which collectively form a maze-like draft channel 51 between the flue gas intake passages 63 and the discharge passage 56 through which the flue gas enters chamber 62. The underside of each of the partitions 50, as well as the underside of the ceiling above the upper passage 49, is provided with a series of ribs extending longitudinally in the direction of flue gas flow through each passage 49. Access to the interior of the housing 48 is afforded by a means of a closure plate 61 which encloses and encompasses all of the separate passages 49.

To ensure good liquid circulation, the liquid-conducting partitions 50, as can be seen from FIG. 14, are disposed at a slight slant from sidewall to sidewall.

In the embodiment illustrated, the continuously rising flue gas reverses direction twice during flow through the passages 49, a process which naturally involves ash precipitation, particularly where changes in direction take place. There is accordingly provided, beneath the turning zone 55, an ash pit chamber 53' equipped with a removable ash collecting box 57'. A functionally equivalent, removable ash collecting box 57 is provided in ash pit chamber 53 beneath the flue gas vent 52 in chamber 62. The flue gas vent 52 preferably extends downwardly in substantially the manner illustrated in FIG. 13 so as to enhance precipitation efficiency.

The separate passages 49 can be cleaned by means of associated cleaning elements 58 which extend through the closure plate 61. Each cleaning element 58 consists of a rod 59 and slide plate 60. A typical slide plate 60, as illustrated in FIG. 15, is complementary in profile to the longitudinal ribs 54 and so dimensioned that when the cleaning element 58 is shoved through the passage 49 either automatically or by hand, it not only meshes with the longitudinal ribs 54 but also sweeps the floor of the passage 49.

It has been found that the removal of ash is so thorough that a heating boiler equipped with a flue gas heat exchange chamber 16, as described above, can be readily vented through a normal chimney without the intermediary addition of any special ash extractor which would increase venting resistance.

The heating boiler can suitably be provided with any required, or desired, masonry linings and/or insulation, a matter well within the purview of a person skilled in the art. Additionally, various modifications within the true broad spirit and scope of the invention will also be obvious to a person skilled in the art.

I claim:

1. A heating boiler for the combustion of baled straw, comprising an enclosed straw feed channel, provided with conveyor means, communicating with a combustion chamber having a combustion zone adjacent the rear wall of the combustion chamber, a flue gas heat exchange chamber above the combustion chamber and in communication with a flue gas vent, an ash collecting pit below the combustion chamber, a horizontal floor disposed between the combustion chamber and the ash collecting pit and having a slot adjacent the rear wall of the combustion chamber for passage of ash from the combustion zone into the ash collecting pit and for intake of primary air into the combustion zone, an ash stripper assembly extending from the rear wall of the combustion chamber and movable in a vertical plane to strip ash from the surface of a straw bale being combusted in the combustion zone, and at least one secondary air intake in the rear wall of the combustion chamber.

2. A heating boiler according to claim 1, wherein the ash stripper assembly includes a cross arm member mounted upon a hollow shaft which extends through the rear wall of the combustion chamber, the cross arm member being provided with a plurality of stripper fingers extending towards the combustion zone, and the hollow shaft being rotatable in at least one direction and constituting a secondary air intake.

3. A heating boiler according to claim 2, wherein the ash stripper assembly having the hollow shaft is axially movable against the pressure of spring means remote from the combustion chamber.

4. A heating boiler according to claim 2 or claim 3, wherein the stripper fingers of the ash stripper assembly are progressively shorter towards the ends of the cross arm member.

5. A heating boiler according to claim 1, wherein wedge-like members are provided in the combustion chamber to further compress the baled straw being fed to the combustion zone.

6. A heating boiler according to claim 1, wherein a section of the floor of the combustion chamber adjacent the slot adjacent the rear wall of the combustion chamber has a centrally disposed longitudinal slot intermediate complementary downwardly curved portions.

7. A heating boiler according to claim 1, wherein the straw feed channel is horizontally rectangular in cross-section and adapted to accept round straw bales inserted horizontally.

8. A heating boiler according to claim 1, wherein the ash stripper assembly includes a hollow shaft which extends through the rear wall of the combustion chamber, the end of the hollow shaft adjacent the combustion zone having complementary spaced arms inclined from about the axis of the shaft towards the rear wall of the combustion chamber, each arm having a plurality of ash stripper elements extending towards the combustion zone and, associated with the upper and lower side of each arm, at least one swivellable flank stripper member for free movement along the arm between limiting stop means.

9. A heating boiler according to claim 8, wherein the ash stripper assembly includes, remote from the arms, at least one additional stripper member attached to the hollow shaft for free movement between associated limiting stop means.

10. A heating boiler according to claim 8 or claim 9, wherein the stripper elements are in the shape of triangles or vanes extending from the arms.

11. A heating boiler according to claim 8, wherein there is provided a regulating element associated with the hollow shaft exteriorly of the combustion chamber, the regulating element in turn being associated with an impulse transmitter connected to drive means for at least one of the ash stripper assembly and the baled straw conveyor means.

12. A heating boiler according to claim 1 or claim 11, wherein a door is provided in the rear wall of the combustion chamber, the door including on the side remote from the combustion chamber an upwardly extending bracket from which is swivellably suspended a bearing mounting for the ash stripper assembly.

13. A heating boiler according to claim 1, wherein the flue gas heat exchange chamber is in the shape of a box-type housing, the interior space of the housing being divided into separate horizontal passages which form a maze-like draft channel, the horizontal passages being separated by liquid-conducting partitions having downwardly extending ribs extending longitudinally in the direction of flue gas flow through each passage, the housing further having at least one ash collecting chamber with a selectively removable ash box.

14. A heating boiler according to claim 13, wherein the housing includes a cleaning element for each separate horizontal passage, each cleaning element including a rod selectively moveable in the direction of the longitudinal ribs and having, on the end of the rod, a comb-like slide plate complementary in profile to the longitudinal ribs and the dimensions of the passage.

15. A heating boiler according to claim 14, wherein the cleaning element rods extend exteriorly of the housing through a closure plate which encompasses and encloses all of the separate passages.

16. A heating boiler according to claim 13, wherein the outlet of the maze-like draft channel discharges into a chamber having a selectively removable ash box disposed beneath a flue gas vent.

* * * * *